US007470337B2

(12) United States Patent
Mendenhall et al.

(10) Patent No.: US 7,470,337 B2
(45) **Date of Patent: *Dec. 30, 2008**

(54) GAS GENERATION WITH COPPER COMPLEXED IMIDAZOLE AND DERIVATIVES

(75) Inventors: Ivan V. Mendenhall, Providence, UT (US); Robert D. Taylor, Hyrum, UT (US)

(73) Assignee: Autoliv ASP, Inc., Ogden, UT (US)

( * ) Notice: Subject to any disclaimer, the term of this patent is extended or adjusted under 35 U.S.C. 154(b) by 72 days.

This patent is subject to a terminal disclaimer.

(21) Appl. No.: 11/385,376

(22) Filed: Mar. 21, 2006

(65) Prior Publication Data

US 2007/0240797 A1 Oct. 18, 2007

(51) Int. Cl.
*C06B 31/00* (2006.01)
*D03D 23/00* (2006.01)
*D03D 43/00* (2006.01)

(52) U.S. Cl. ..... 149/45; 149/109.4; 149/109.6

(58) Field of Classification Search ..... 149/45, 149/109.4, 109.6

See application file for complete search history.

(56) References Cited

U.S. PATENT DOCUMENTS 4,300,962 A 11/1981 Stinecipher et al.
5,538,568 A 7/1996 Taylor et al.
5,608,183 A 3/1997 Barnes et al.
5,635,668 A 6/1997 Kantesaria et al.
6,143,102 A 11/2000 Mendenhall et al.
6,156,136 A 12/2000 Bottaro et al.
6,550,808 B1 4/2003 Mendenhall
6,592,691 B2 7/2003 Taylor et al.
6,958,101 B2 * 10/2005 Mendenhall et al. ..... 149/45
2003/0037850 A1 * 2/2003 Helmy et al. ..... 149/19.4
2004/0216820 A1 11/2004 Mendenhall et al.
2006/0054257 A1 * 3/2006 Mendenhall et al. ..... 149/45

* cited by examiner

*Primary Examiner*—Michael A Marcheschi
*Assistant Examiner*—James E McDonough
(74) *Attorney, Agent, or Firm*—Sally J Brown; Paule Petersen & Erickson

(57) ABSTRACT

A compound including at least one copper II complex of a material selected from the group of imidazole and imidazole derivatives is provided for use in a gas generant composition. An associated burn rate enhanced gas generant composition, in addition to such copper complex-containing compound, also includes a nitrogen-containing non-azide fuel. Additionally provided are methods for improving the combustion performance of a non-azide gas generant composition in at least one aspect selected from the group consisting of ignitability, burn rate and burn rate pressure sensitivity, through the addition of such copper complex-containing compound to the non-azide gas generant composition.

19 Claims, 2 Drawing Sheets

GAS GENERATION WITH COPPER COMPLEXED IMIDAZOLE AND DERIVATIVES

BACKGROUND OF THE INVENTION

This invention relates generally to a material for use in gas generation such as for forming an inflation gas for inflating inflatable devices such as airbag cushions included in automobile inflatable restraint systems. In particular, the invention relates to a material including a copper complex of imidazole or an imidazole derivative.

Gas generating materials are useful in a variety of different contexts. One significant use for such compositions is in the operation of automotive inflatable restraint airbag cushions.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Such systems typically also include one or more crash sensors mounted on or to the frame or body of the vehicle to detect sudden decelerations of the vehicle and to electronically trigger activation of the system. Upon actuation of the system, the cushion begins to be inflated or expanded, in a matter of no more than a few milliseconds, with gas produced or supplied by a device commonly referred to as an "inflator." In practice, such an airbag cushion is desirably deployed into a location within the vehicle between the occupant and certain parts of the vehicle interior, such as a door, steering wheel, instrument panel or the like, to prevent or avoid the occupant from forcibly striking such part(s) of the vehicle interior. As a consequence, nearly instantaneous gas generation is generally desired and required for the effective operation of such inflatable restraint installations.

Various gas generant compositions have heretofore been proposed for use in vehicular occupant inflatable restraint systems. Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials was in accordance with industry specifications, guidelines and standards, such use could potentially involve or raise potential concerns such as involving the safe and effective handling, supply and disposal of such gas generant materials. Thus, there has been an ongoing need for alternative gas generant materials of further improved safety and/or effectiveness. In particular, there has been a need for alternative gas generants, such as composed of an azide-free fuel material and an oxidizer therefor, such as upon actuation react to form or produce an inflation gas for inflating vehicular safety restraint devices.

In view of this need, significant efforts have been directed to minimizing or avoiding the use of sodium azide in automotive airbag inflators. Through such efforts, various combinations of non-azide fuels and oxidizers have been proposed for use in gas generant compositions. These non-azide fuels are generally desirably less toxic to make and use, as compared to sodium azide, and may therefore be easier to dispose of and thus, at least in part, found more acceptable by the general public. Further, non-azide fuels composed of carbon, hydrogen, nitrogen and oxygen atoms typically yield all gaseous products upon combustion. As will be appreciated by those skilled in the art, fuels with high nitrogen and hydrogen contents and a low carbon content are generally attractive for use in such inflatable restraint applications due to their relatively high gas outputs (such as measured in terms of moles of gas produced per 100 grams of gas generant material).

Most oxidizers known in the art and commonly employed in gas generant compositions are metal salts of oxygen-bearing anions (such as nitrates, chlorates and perchlorates, for example) or metal oxides. Unfortunately, upon combustion, the metallic components of such oxidizers typically end up as a solid and thus reduce the relative gas yield realizable therefrom. Consequently, the amount of such oxidizers in particular gas generant formulations typically affects the gas output or yield of the formulation. If oxygen is incorporated into the fuel material, however, lesser relative amount of such an oxidizer may be required and the gas output of the formulation can be increased.

In addition to low toxicity and high gas outputs, preferred gas generant materials are desirably thermally stable (i.e., desirably decompose only at temperatures greater than about 160° C.), have a low affinity for moisture and, are relatively inexpensive to prepare and/or manufacture.

Moreover, in addition to the above-identified desirable properties and characteristics, gas generant materials for use in automotive inflatable restraint applications must be sufficiently reactive such that upon the proper initiation of the reaction thereof, the resulting gas producing or generating reaction occurs sufficiently rapidly such that a corresponding inflatable airbag cushion is properly inflated so as to provide desired impact protection to an associated vehicle occupant. In general, the burn rate for a gas generant composition can be represented by the equation (1), below:

$$r_b = k(P)^n \tag{1}$$

where, $r_b$=burn rate (linear)

k=constant

P=pressure n=pressure exponent, where the pressure exponent is the slope of a linear regression line drawn through a log-log plot of burn rate versus pressure.

Guanidine nitrate ($CH_6N_4O_3$) is a non-azide fuel with many of the above-identified desirable fuel properties and which has been widely utilized in the automotive airbag industry. For example, guanidine nitrate is commercially available, relatively low cost, non-toxic, provides excellent gas output due to a high content of nitrogen, hydrogen and oxygen and a low carbon content and has sufficient thermal stability to permit spray dry processing. Unfortunately, guanidine nitrate suffers from a lower than may be desired burn rate. Thus, there remains a need and a demand for an azide-free gas generant material which may more effectively overcome one or more of the problems or shortcomings described above.

Commonly assigned Mendenhall, U.S. Pat. No. 6,550,808, issued 22 Apr. 2003, the disclosure of which is fully incorporated herein by reference, relates generally to gas generant compositions which desirably include or contain guanylurea nitrate (also known as dicyandiamidine and amidinourea). In particular, guanylurea nitrate advantageously has a relatively high theoretical density such as to permit a relatively high loading density for a gas generant material which contains such a fuel component. Further, guanylurea nitrate exhibits excellent thermal stability, as evidenced by guanylurea nitrate having a thermal decomposition temperature of 216° C. In addition, guanylurea nitrate has a large negative heat of formation (i.e., −880 cal/gram) such as results in a cooler burning gas generant composition, as compared to an otherwise similar gas generant containing guanidine nitrate.

While the inclusion or use of guanylurea nitrate in gas generant materials can serve to minimize or avoid reliance on the inclusion or use of sodium azide or other similar azide materials while providing improved burn rates and overcoming one or more of the problems, shortcomings or limitations such as relating to cost, commercial availability, low toxicity, good thermal stability and low affinity for moisture, even further improvement in the burn rate of gas generant formulations may be desired or required for particular applications.

Basic copper nitrate ($Cu(NO_3)_2.3Cu(OH)_2$) (sometimes referred to herein by the notation "BCN" or "bCN") has or exhibits various desirable properties or characteristics including, for example, high gas output, density and thermal stability and relatively low cost such as to render desirable the use or gas generant composition inclusion thereof as an oxidizer. The use of such basic copper nitrate or related materials has been the subject of various patents including Barnes et al, U.S. Pat. No. 5,608,183, issued 4 Mar. 1997; Barnes et al, U.S. Pat. No. 5,635,688, issued 3 Jun. 1997, and Mendenhall et al., U.S. Pat. No. 6,143,102, issued 7 Nov. 2000, the disclosures of which are fully incorporated herein by reference.

In practice, it is generally desired or required that inflators for inflatable restraint systems be able to supply or provide inflation gas at predetermined mass flow rates. The gas mass flow rate resulting upon the combustion of a gas generant composition is typically a function of the surface area of the gas generant undergoing combustion and the burn rate thereof. Unfortunately, a limitation on the greater or more widespread use of basic copper nitrate in such gas generant compositions is that basic copper nitrate-containing gas generant compositions may exhibit or otherwise have associated therewith undesirably low or slow burn rates. In practice, the normal or typical burn rates associated with such gas generant compositions can act to restrict the use of such gas generant compositions to those applications wherein faster burn rates are neither required nor desired. For example, such low or slow burn rate compositions may be unsuited for various side impact applications where more immediate generation or supply of inflation gas may be required or desired.

For some inflator applications, a gas generant formulation exhibiting a relatively low burn rate can be at least partially compensated for by reducing the size of the shape or form of the gas generant material such as to provide the gas generant material in a shape or form having a relatively larger reactive surface area. In practice, however, there are practical limits to the minimum size to which a gas generant material shape or form, such as a tablet, for example, can be reproducibly manufactured. Moreover, increased burn rates may be needed for particular applications which require a higher inflator performance.

Another, oftentimes important or critical, performance characteristic of a gas generant material or formulation is burn rate pressure sensitivity. In general materials or formulations which exhibit a reduced or lesser burn rate pressure sensitivity are desirable as such materials and formulations can lead to reduced performance variability such as when the corresponding material or formulation is reacted under different pressure conditions.

Still further, a common shortcoming of various non-azide gas generant formulations is that such formulations may exhibit a tendency to be difficult to ignite. Inflator devices used in automotive inflatable restraint systems commonly include or incorporate relatively intricate and oftentimes expensive ignition systems, such as in the form of an ignition train, to provide or result in desired ignition and proper functioning of the gas generant formulation. Consequently, the ability to eliminate or reduce the size of the ignition train represents a significant potential cost saving for automotive inflatable restraint systems.

Thus, there is a need and a demand for methods or techniques for improving the combustion performance of a gas generant composition, particularly a non-azide gas generant composition, in at least one aspect such as selected from the group consisting of ignitability, burn rate and burn rate pressure sensitivity, for example.

SUMMARY OF THE INVENTION

A general object of the invention is to provide a material for use in a pyrotechnic composition.

A more specific objective of the invention is to overcome one or more of the problems described above.

The general object of the invention can be attained, at least in part, through a compound that includes at least one copper II complex of a material selected from the group of imidazole and imidazole derivatives.

The prior art generally fails to provide as effective as may be desired methods or techniques for improving the combustion performance of a gas generant composition, particularly a non-azide gas generant composition, in at least one aspect such as selected from the group consisting of ignitability, burn rate and burn rate pressure sensitivity, for example.

In accordance with one embodiment, there is provided a burn rate enhanced gas generant composition that, in addition to a compound that includes at least one copper II complex of a material selected from the group of imidazole and imidazole derivatives, also includes a nitrogen-containing non-azide fuel and an oxidizer.

As described in greater detail below, specific nitrogen-containing non-azide fuel materials for use in accordance with certain preferred embodiments, are organic fuels selected from the group consisting of guanidine nitrate, nitroguanidine, aminoguanidine nitrate, diaminoguanidine nitrate, triaminoguanidine nitrate, guanylurea nitrate, tetrazoles, bitetrazaoles, azodicarbonamide and mixtures thereof. Moreover, specific oxidizer materials for use in accordance with certain preferred embodiments, are desirably selected from the group consisting of alkali metal nitrates, alkali metal perchlorates, alkaline earth metal nitrates, alkaline earth metal perchlorates, basic metal nitrates, metal ammine nitrates, metal oxides, metal hydroxides, ammonium nitrate, ammonium perchlorate and mixtures thereof.

In accordance with another aspect, there is provided a method for improving the combustion performance of a non-azide gas generant composition in at least one aspect selected from the group consisting of ignitability, burn rate and burn rate pressure sensitivity. In accordance with one such method, a compound that includes at least one copper II complex of a material selected from the group of imidazole and imidazole derivatives is added to the non-azide gas generant composition. In more specific embodiments, methods for increasing ignitability of a non-azide gas generant composition; methods for increasing a burn rate of a non-azide gas generant composition; and methods for lessening burn rate pressure sensitivity of a non-azide gas generant composition, are provided.

As used herein, references to a specific composition, component or material as a "fuel" are to be understood to refer to a chemical which generally lacks sufficient oxygen to burn completely to $CO_2$, $H_2O$ and $N_2$.

Correspondingly, references herein to a specific composition, component or material as an "oxidizer" are to be understood to refer to a chemical generally having more than sufficient oxygen to burn completely to $CO_2$, $H_2O$ and $N_2$.

References herein to a fuel or oxidizer as "primary" are to be understood to generally refer to the respective fuel or oxidizer that is present in the greatest concentration or relative amount.

Other objects and advantages will be apparent to those skilled in the art from the following detailed description taken in conjunction with the appended claims and drawings.

DETAILED DESCRIPTION OF THE INVENTION

Figure 1:
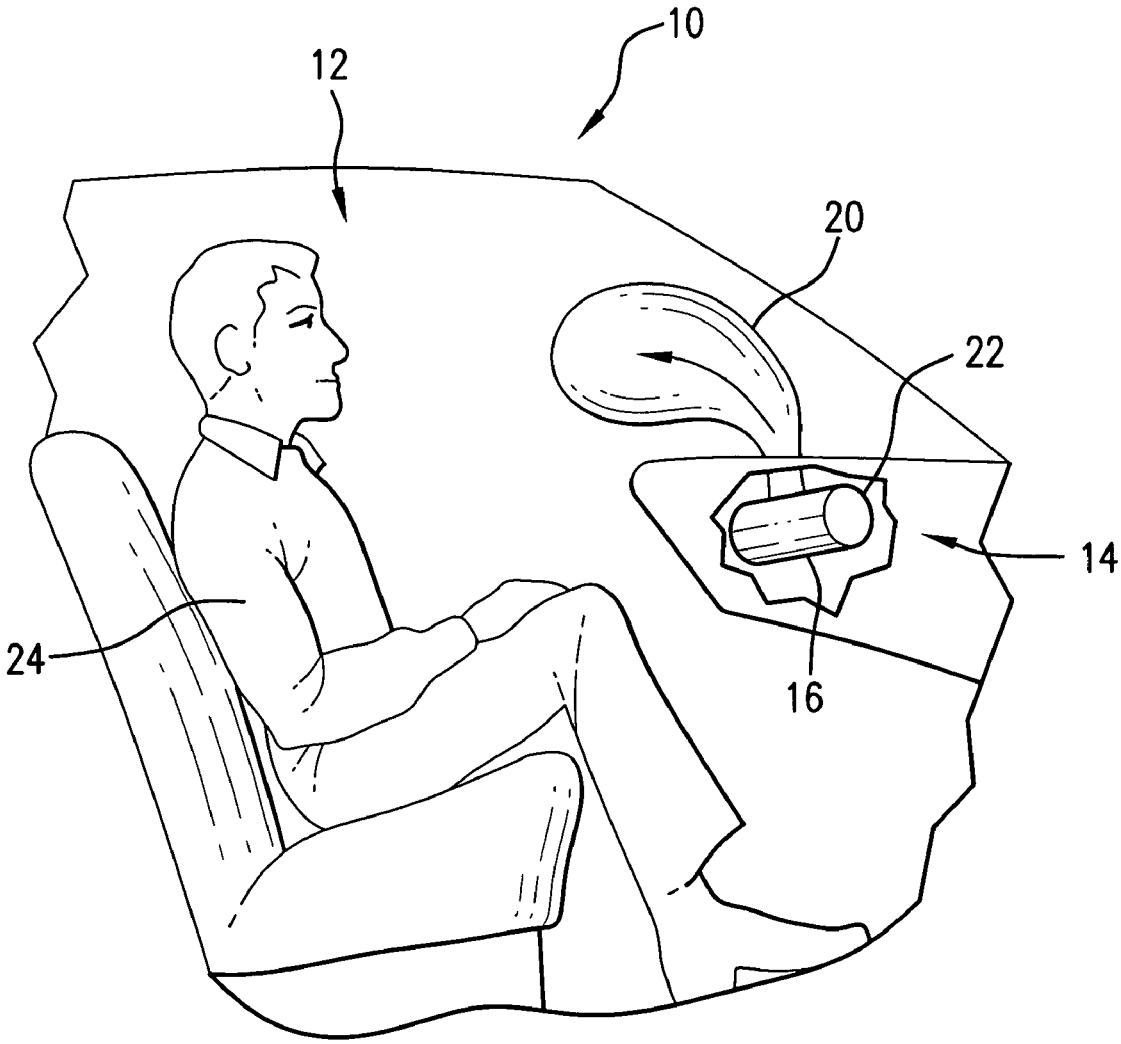
FIG. 1 is a simplified schematic, partially broken away, view illustrating the deployment of an airbag cushion from an airbag module assembly within a vehicle interior, in accordance with one preferred embodiment.

The present invention provides a material such as for use in or as a gas generant composition such as used in the inflation of inflatable elements such as an airbag cushion of an automobile inflatable restraint system and, more particularly, to the enhancement or improvement of the performance of the use of such material in one or more aspect such as ignitability, burn rate and burn rate pressure sensitivity, for example. In accordance with one particular aspect of the invention, there is provided a burn rate enhanced gas generant composition which includes at least one nitrogen-containing non-azide fuel and an oxidizer, such as basic copper nitrate.

As described in greater detail below, such gas generant composition or formulation material desirably is a compound that is or includes a copper II complex of at least one of imidazole or an imidazole derivative. Specific examples of compounds for use in the practice of the invention include copper II complexes of bis-imidazole, bis-nitroimidazole, imidazole hydroxide, nitroimidazole hydroxide, imidazole nitroimidazole and mixtures thereof.

Those skilled in the art and guided by the teachings herein provided will appreciate that such compounds can be formed or produced by, through or via various chemical reactions and associated processing schemes. A few representative reactions within the scope of the present invention are as follows:

$$Cu(OH)_2+2C_3H_3N_3O_2(\text{4-nitroimidazole})\rightarrow Cu(C_3H_2N_3O_2)_2(\text{copper II bis-4-nitroimidazole})+2H_2O; \quad (1)$$

$$Cu(OH)_2+C_3H_3N_3O_2(\text{4-nitroimidazole})\rightarrow Cu(C_3H_2N_3O_2)(OH)(\text{copper II bis-4-nitroimidazole hydroxide})+H_2O; \quad (2)$$

$$Cu(OH)_2+2C_3H_3N_2(\text{imidazole})\rightarrow Cu(C_3H_2N_2)_2(\text{copper II bis-imidazole})+2H_2O; \quad (3)$$

$$Cu(OH)_2+C_3H_3N_2(\text{imidazole})\rightarrow Cu(C_3H_2N_2)(OH)(\text{copper II imidazole hydroxide})+H_2O; \quad (4)$$

$$Cu(OH)_2+C_3H_3N_2(\text{imidazole})+C_3H_3N_3O_2(\text{4-nitroimidazole})\rightarrow Cu(C_3H_2N_2)(C_3H_2N_3O_2)(\text{copper II imidazole 4-nitroimidazole})+2H_2O. \quad (5)$$

The invention also contemplates and encompasses processing employing similar production reactions but now utilizing copper compounds such as either or both cupric oxide and basic copper carbonate in place of copper hydroxide, in whole or in part. Those skilled in the art and guided by the teachings herein provided will appreciate that the isomer 2-nitroimidazole or a mixture of the isomers may be utilized.

The described copper II complex of at least one of imidazole or an imidazole derivative compounds or materials may be utilized as a pyrotechnic composition such as may be included in an inflator device of an automobile inflatable restraint system. Alternatively, the described copper II complex of at least one of imidazole or an imidazole derivative compounds or materials may be used in a pyrotechnic composition such as an igniter composition, an autoignition composition or a gas generant composition and such as may additionally include additional components such as a co-fuel. Typically, such copper complex-containing compositions of the invention may advantageously include from about 1 to about 30 composition weight percent of the subject copper II complex of at least one of imidazole or an imidazole derivative compounds or materials.

While the broader practice of the invention is not necessarily limited to the incorporation or use of such copper complex of imidazole or imidazole derivative in combination or conjunction with particular or specific gas generant formulations, particularly gas generant formulations or compositions free of azide fuel, the invention is believed to have particular benefit or utility in gas generant formulations that include a primary fuel component composed of either or both one or more nitrogen-containing organic compounds and one or more transition metal complexes of nitrogen-containing organic compounds and basic copper nitrate as a primary oxidizer. In accordance with certain preferred embodiments, such copper II complex of at least one of imidazole or an imidazole derivative compound or material can desirably serve to improve the combustion performance of such a non-azide gas generant composition in at least one aspect selected from the group consisting of ignitability, burn rate and burn rate pressure sensitivity. For example, in accordance with one preferred embodiment, the desirable inclusion of such copper II complex of at least one of imidazole or an imidazole derivative compound or material can at least desirably increase the ignitability of the non-azide gas generant composition. In accordance with another preferred embodiment, the desirable inclusion of such copper II complex of at least one of imidazole or an imidazole derivative compound or material can at least desirably increase the burn rate of the non-azide gas generant composition. In accordance with another preferred embodiment, the desirable inclusion of such copper II complex of at least one of imidazole or an imidazole derivative compound or material can at least desirably lessen the burn rate pressure sensitivity of the non-azide gas generant composition.

Those skilled in the art and guided by the teachings herein provided will appreciate that the invention can desirably be practice via the inclusion of a sufficient quantity of at least one such copper II complex of a material selected from the group of imidazole and imidazole derivatives such that the resulting formulation exhibits a desirable increase in ignitability and/or burn rate as well as or alternatively a desirable decrease in burn rate pressure sensitivity, as compared to the same formulation without the inclusion of such copper II complex of a material selected from the group of imidazole and imidazole derivatives. In accordance with a preferred embodiment, a gas generant formulation desirably contains or includes between about 1 to about 30 composition weight percent of the copper complex compound.

As identified above, such gas generant compositions desirably contain or include at least one non-azide nitrogen-containing fuel compound. In practice, such gas generant compositions may desirably include about 1 up to about 90 composition weight percent non-azide nitrogen-containing fuel compound(s) such as suited for vehicular inflatable safety restraint applications. In accordance with particular preferred embodiments, suitable non-azide nitrogen-containing fuel compounds may desirably be an organic fuel, such as one or more of guanidine nitrate, nitroguanidine, aminoguanidine nitrate, diaminoguanidine nitrate, triaminoguanidine nitrate, guanylurea nitrate, tetrazoles, bitetrazoles, azodicarbonamide and mixtures thereof. Particular non-azide nitrogen-containing fuel compounds include guanidine nitrate and hexamine cobalt III nitrate. The desirability of use of guanidine nitrate in such gas generant compositions is generally based on a combination of factors such as relating to cost, stability (e.g., thermal stability), availability and compatibility (e.g., compatibility with other standard or useful gas generant composition components, for example).

As described in greater detail below, a gas generant composition in accordance with one particularly preferred embodiment includes about 5 to about 60 composition weight percent guanidine nitrate and, in accordance with another particularly preferred embodiment, includes guanidine nitrate present in a relative amount of about 1 to about 30 composition weight percent and hexamine cobalt III nitrate present in a relative amount of about 1 to about 70 composition weight percent.

If desired, compositions in accordance with the invention may advantageously include additional oxidizer in an amount of up to about 70' composition weight percent. Preferred suitable such oxidizer materials include alkali metal nitrates, alkali metal perchlorates, alkaline earth metal nitrates, alkaline earth metal perchlorates, basic metal nitrates, metal ammine nitrates, metal oxides, metal hydroxides, ammonium nitrate, ammonium perchlorate and mixtures thereof. In one embodiment, the preferred additional oxidizer includes a basic metal nitrate such as basic copper nitrate.

Gas generant compositions in accordance with the invention and suited for extrusion processing desirably also include a binder component. Advantageously, the binder component is a polymeric binder material effective to impart sufficient cohesive properties to the gas generant composition whereby the gas generant composition is extrudable. Extrudable gas generant compositions in accordance with certain preferred embodiments will desirably include or contain about 1 to about 20 composition weight percent of such a polymeric binder component.

Examples of suitable binder materials can include cellulosics, natural gums, polyacrylates, polyacrylamides, polyurethanes, polybutadienes, polystyrenes, polyvinyl alcohols, polyvinyl acetates, silicones and combinations of two or more thereof. More particularly, suitable cellulosic binder materials may include ethyl cellulose, carboxymethyl cellulose, hydroxylpropyl cellulose and combinations of two or more thereof. Suitable natural gum binder materials may include guar, xanthan, arabic and combinations of two or more thereof. Those skilled in the art and guided by the teachings herein provided will further appreciate that the incorporation of binder materials, such as the above-described cellulosic binders, that result in or form compositions that burn at lower temperatures, sometimes referred to as "cooler burning" materials, can be advantageously preferred for various applications.

Those skilled in the art and guided by the teachings herein provided will appreciate that such gas generant compositions prepared via extrusion processing can desirably exhibit increased or maximized loading densities such as may desirably serve to reduce or minimize the required chamber volume associated therewith. Such extruded gas generant compositions may further desirably more easily burn at higher pressure conditions and can thus serve to reduce or minimize the production or yield of incomplete products of combustion such as having the general form of $CO_x$ and $NO_x$, for example.

One or more of the materials or ingredients included in the subject compositions may serve multiple roles or functions in particular formulations. For example, binder materials can also typically act or function as a fuel components, as above defined. Thus, specific range limits for particular materials includable in the subject compositions are generally dependent, at least in part, on what other particular materials are included in a specific composition. Such specific range limits for particular materials includable in the subject compositions are readily identifiable by those skilled in the art and guided by the teachings herein provided.

Additional additives such as slag forming agents, flow aids, plasticizers, viscosity modifiers, pressing aids, dispersing aids, or phlegmatizing agents may also be included in the pyrotechnic composition to facilitate processing or to provide enhanced properties. For example, pyrotechnic compositions in accordance with the invention may include a slag forming agent such as a metal oxide compound such as aluminum oxide. Generally, such additives may be included in the subject compositions in an amount of about 1 to no more than about 5 composition weight percent. Such additives typically are one or more metal oxide materials, with preferred such additives including metal oxides such as silicon dioxide, aluminum oxide, zinc oxide, and combinations thereof.

The above-identified processing reactions for the production of the compound comprising at least one copper II complex of a material selected from the group of imidazole and imidazole derivatives are conducive to in-situ production, such as in a processing vessel such as a mix tank prior to spray dry processing of the corresponding gas generant formulation. For example, a processing vessel, such as a spray dry mix tank, can be charged with water; with imidazole, 4-nitroimidazole or other desired imidazole derivative and selected copper compound (e.g., cupric hydroxide) added to the reaction vessel content to form a slurry; the temperature of the slurry can then be equilibrated such as at a temperature of 190° F. (88° C.) and held there until the reaction is complete (approximately one hour). Other desired gas generant compositions ingredients, such as fuel, oxidizer, slagging aids, etc., can be added to the reaction mixture and the resulting slurry pumped to a nozzle and spray dried. Further processing steps such as blending, pressing, igniter coating, etc. can be preformed per standard procedures.

As will be appreciated, gas generating compositions in accordance with the invention can be incorporated, utilized or practiced in conjunction with a variety of different structures, assemblies and systems. As representative, FIG. 1 illustrates a vehicle 10 having an interior 12 wherein an inflatable vehicle occupant safety restraint system, generally designated by the reference numeral 14, is positioned. As will be appreciated, certain standard elements not necessary for an understanding of the invention may have been omitted or removed from FIG. 1 for purposes of facilitating illustration and comprehension.

The vehicle occupant safety restraint system 14 includes an open-mouthed reaction canister 16 which forms a housing for an inflatable vehicle occupant restraint 20, e.g., an inflatable airbag cushion, and an apparatus, generally designated by the reference numeral 22, for generating or supplying inflation gas for the inflation of an associated occupant restraint. As identified above, such a gas generating device is commonly referred to as an "inflator."

The inflator 22 contains a quantity of a gas generant composition in accordance with the invention and such as described above. The inflator 22 also includes an ignitor, such as known in the art, for initiating combustion of the gas generating composition in ignition communication with the gas generant composition. As will be appreciated, the specific construction of the inflator device does not form a limitation on the broader practice of the invention and such inflator devices can be variously constructed such as is also known in the art.

In practice, the airbag cushion 20 upon deployment desirably provides for the protection of a vehicle occupant 24 by restraining movement of the occupant in a direction toward the front of the vehicle, i.e., in the direction toward the right as viewed in FIG. 1.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Gas generant compositions containing a copper II complex in accordance with the invention, e.g., alternatively containing copper II bis-4-nitroimidazole, copper II imidazole and copper II imidazole hydroxide, respectively, were prepared and tested relative to a similar comparative gas generant composition but not containing a copper II complex in accordance with the invention.

Examples 1-4 and Comparative Example 1

In these tests, 100 gram batches of each of the gas generant compositions shown in TABLE 1 below were prepared by mixing in an aqueous slurry and oven dried.

TABLE 1

| | CE 1 | Ex 1 | Ex 2 | Ex 3 | Ex 4 |
|---|---|---|---|---|---|
| bCN | 53.16 | 50.49 | 62.18 | 556.02 | 55.68 |
| GN | 43.36 | 36.51 | 24.82 | 30.98 | 21.32 |
| $Al_2O_3$ | 3.48 | 3.00 | 3.00 | 3.00 | 3.00 |
| CC-1 | — | 10.00 | — | — | 20.00 |
| CC-2 | — | — | 10.00 | — | — |
| CC-3 | — | — | — | 10.00 | — |

where,
bCN = basic copper nitrate;
GN = guanidine nitrate;
CC-1 = copper II bis-4-nitroimidazole;
CC-2 = copper II imidazole; and
CC-3 = copper II imidazole hydroxide These gas generant compositions were then respectively pressed into the shape of cylinders (0.5 inch in diameter). The length of each of the cylinders was measured and recorded.

The cylinders formed of the gas generant compositions of Examples 1-4 and Comparative Example 1 were each then tested employing the following testing regime:

One end of the particular gas generant composition cylinder being tested was covered with a piece of masking tape and the other surfaces of the cylinder were coated with a polymer that inhibits ignition. The cylinder was then placed upright in a one-liter stainless steel vessel. A nichrome wire was placed across the top of the cylinder in contact with the uncoated end and connected to two electrodes. A small charge of igniter powder was placed over the nichrome wire to accelerate ignition of the cylinder. The test tank was sealed and pressurized to 900 psi with an inert gas (e.g., nitrogen). Current was passed through the electrodes and the cylinder ignited. The gas generant burnt in a linear fashion and produced gas to increase the pressure in the test tank. The tank pressure was read and recorded at millisecond intervals. A plot of pressure vs. time showed the start and the end of the gas generant burn. The length of the cylinder divided by the time required for burning provided a measurement of the burn rate. This experiment is repeated at 1350, 2000, and 3000 psi and a plot of the log burn rate vs. log average pressure resulted in a straight line with slope=n and y intercept=b. Estimation of the two parameters allowed calculation of the burn rate at any pressure through the following equation:

$$\text{Burn rate(inches/sec)}=kP^n$$

where,
P=pressure in psi
n=slope
k=constant=$10^b$
b=y intercept

TABLE 2 below identifies the values obtained for $r_b$, n and k for the burn rate equation (1), identified above, as well as the density (as measured for each of these gas generant compositions) and the gas yield for each of these gas generant compositions as calculated in each case using the commercially available software program "PEP 1" (Propulsion Evaluation Program), compiled by Martin Marietta.

TABLE 2

| | CE 1 | EX 1 | EX 2 | EX 3 | EX 4 |
|---|---|---|---|---|---|
| $r_b$ (3000) | 0.62 | 0.84 | 0.69 | 0.75 | 1.13 |
| n | 0.42 | 0.37 | 0.30 | 0.30 | 0/36 |
| k | 0.024 | 0.043 | 0.064 | 0.066 | 0.063 |
| density | 1.91 | 2.03 | 2.16 | 2.16 | 2.17 |
| gas yield | 2.90 | 2.60 | 2.30 | 2.50 | 2.28 |

where,
$r_b$ (3000) = burn rate at 3000 psi in inch per second (ips);
n = pressure exponent in the burn rate equation (1) identified above, where the pressure exponent is the slope of the plot of the log of pressure along the x-axis versus the log of the burn rate along the y-axis;
k = the constant in the burn rate equation (1) identified above;
density = density measured in (g/cc); and
gas yield = gas yield calculated in (moles/100 g).

Example 5 and Comparative Example 2

In these tests, 100 gram batches of each of the gas generant compositions shown in TABLE 3 below were prepared by mixing in an aqueous slurry and oven dried, similar to as described above relative to Examples 1-4 and Comparative Example 1.

TABLE 3

| | CE 2 | EX 5 |
|---|---|---|
| bCN | 45.97 | 34.34 |
| hexamine cobalt III nitrate | 52.53 | 45.66 |
| GN | 10.00 | 10.00 |
| CC-1 | — | 10.00 |

where,
bCN = basic copper nitrate;
GN = guanidine nitrate; and
CC-1 = copper II bis-4-nitroimidazole.

The gas generant formulation of each of Comparative Example 2 and Example 5 was then pressed into the shape of cylinders and tested, as described above relative to Examples 1-4 and Comparative Example 1.

TABLE 4 below identifies the values obtained for $r_b$, n and k for the burn rate equation (1), identified above, as well as the density and the gas yield for each of these gas generant compositions, the densities and gas yield in each case were calculated using the above-referred to commercially available software program "PEP 1" (Propulsion Evaluation Program), compiled by Martin Marietta.

TABLE 4

| | CE 2 | EX 5 |
|---|---|---|
| $r_b$ (3000) | 0.40 | 0.77 |
| n | 0.46 | 0.34 |
| k | 0.010 | 0.051 |
| density | 1.93 | 1.98 |
| gas yield | 3.40 | 2.94 |

where,
$r_b$ (3000) = burn rate at 3000 psi in inch per second (ips);
n = pressure exponent in the burn rate equation (1) identified above, where the pressure exponent is the slope of the plot of the log of pressure along the x-axis versus the log of the burn rate along the y-axis;
k = the constant in the burn rate equation (1) identified above;
density = density calculated in (g/cc); and
gas yield = gas yield calculated in (moles/100 g)

Example 6

In this test, the gas generant formulation of Example 5 (identified above) was formed into tablets and the performance of these gas generant tablets was evaluated. In this test, 40 grams of these gas generant tablets were appropriately loaded into a prototype driver inflator device. The prototype inflator device was mated to an inflator discharge-accepting tank equipped with a pressure transducer and the tank pressure vs. time performance obtained therewith was recorded by means of the pressure transducer and associated data collection system.

Figure 2:
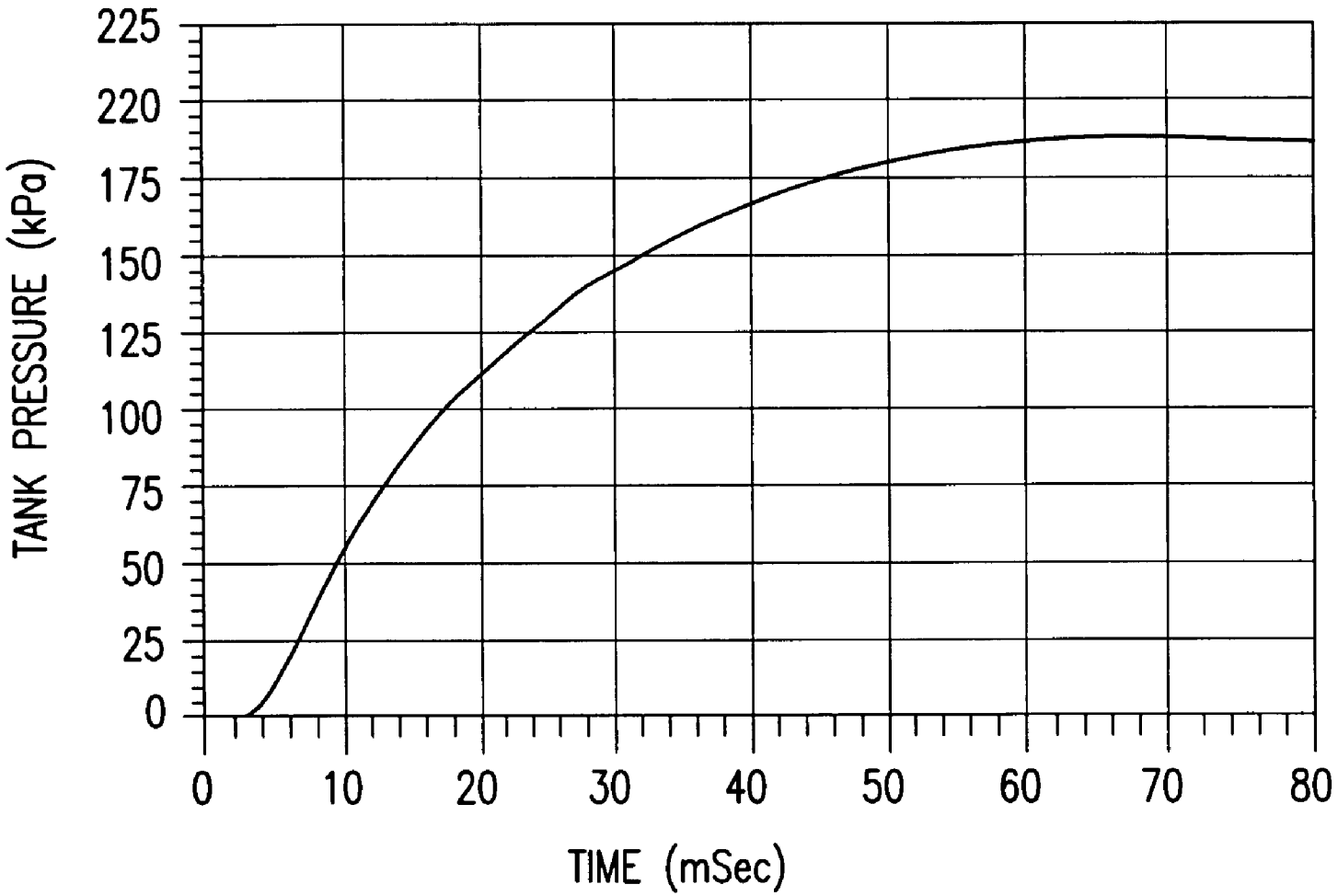
FIG. 2 is a graphical depiction of tank pressure as a function of time performance realized in Example 6 with a prototype inflator device appropriately loaded with tablets of a gas generant composition in accordance with one embodiment.

The tank pressure vs. time performance realized with the prototype inflator device, containing the gas generant tablets of gas generant formulation of Example 5 is shown in FIG. 2. The time to first pressure in the tank was employed as a measure of ignitability.

Discussion of Results

As shown by the data in TABLES 2 and 4, the burn rate (i.e., "$r_b$ (3000)") increased and the pressure sensitivity (i.e., "n") decreased for those formulations including a copper complex of imidazole or an imidazole derivative in accordance with the invention, as compared to the same or similar formulations without such copper complex material.

The pressure versus time trace shown in FIG. 2 shows that acceptable ignition delays were obtained with as little as 0.5 g of auxiliary ignition material. More particularly, employing the commonly applied definition of "ignitability" in terms of the time till pressure is first observed (i.e., measurable) in a tank into which the particular device is fired, the effect of copper II bis-4-nitroimidazole on ignitability was evident in the formulations of each of Examples 1, 4 and 5, it was most pronounced in the formulation containing basic copper nitrate and hexamine cobalt III nitrate (i.e., Example 5) as a time of less than 4 milliseconds for the amount of time till pressure is first observed (i.e. measurable) in a tank into which the device is fired is commonly employed as a measure of "good" ignitability.

Thus, non-azide or azide-free gas generant materials or compositions are provided that, while overcoming at least some of the potential problems or shortcomings of azide-based pyrotechnic compositions, may also provide or result in a sufficient and desirably increased or enhanced burn rate as compared to similar or the same compositions without the copper complexed imidazole and derivative materials described herein. Moreover, at least particular embodiments of the subject gas generant compositions are particularly adapted and well-suited for extrudable production and can thus provide new or facilitate alternative economic and efficient gas generant production techniques.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for improving the combustion performance of a non-azide gas generant composition in at least one aspect selected from the group consisting of ignitability, burn rate and burn rate pressure sensitivity, the method comprising:

adding a compound comprising at least one copper II complex of a material selected from the group of imidazole and imidazole derivatives to the non-azide gas generant composition.

2. The method of claim 1 wherein the compound is added in an amount sufficient whereby the composition includes between about 1 to about 30 composition weight percent of the copper complex.

3. The method of claim 1 wherein said addition of the compound increases ignitability of the non-azide gas generant composition.

4. The method of claim 1 wherein said addition of the compound increases burn rate of the non-azide gas generant composition.

5. The method of claim 1 wherein said addition of the compound lessens burn rate pressure sensitivity of the non-azide gas generant composition.

6. The method of claim 1 wherein the non-azide gas generant composition comprises a nitrogen-containing non-azide fuel and an oxidizer.

7. The method of claim 6 wherein the nitrogen-containing non-azide fuel is an organic fuel selected from the group consisting of guanidine nitrate, nitroguanidine, aminoguanidine nitrate, diaminoguanidine nitrate, triaminoguanidine nitrate, guanylurea nitrate, tetrazoles, bitetrazaoles, azodicarbonamide and mixtures thereof.

8. The method of claim 6 wherein the nitrogen-containing non-azide fuel is hexamine cobalt III nitrate.

9. The method of claim 6 wherein the oxidizer is selected from the group consisting of alkali metal nitrates, alkali metal perchlorates, alkaline earth metal nitrates, alkaline earth metal perchlorates, basic metal nitrates, metal ammine nitrates, metal oxides, metal hydroxides, ammonium nitrate, ammonium perchlorate and mixtures thereof.

10. The method of claim 6 wherein the oxidizer comprises basic copper nitrate.

11. The method of claim 1 wherein the gas generant composition additionally comprises a polymeric binder material effective to render the gas generant composition extrudable.

12. The method of claim 11 wherein the polymeric binder material is present in a relative amount of about 1 to about 20 composition weight percent and wherein the polymeric binder material is selected from the group of cellulosics, natural gums, polyacrylates, polyacrylamides, polyurethanes, polybutadienes, polystyrenes, polyvinyl alcohols, polyvinyl acetates, silicones and combinations of two or more thereof.

13. The method of claim 6 wherein:

the nitrogen-containing non-azide fuel is guanidine nitrate present in a relative amount of about 5 to about 60 composition weight percent;

the oxidizer is basic copper nitrate present in a relative amount of about 30 to about 70 composition weight percent; and the copper complex is present in a relative amount of between about 1 to about 30 composition weight percent.

14. The method of claim 6 wherein:

the nitrogen-containing non-azide fuel comprises guanidine nitrate present in a relative amount of about 1 to about 30 composition weight percent and hexamine cobalt III nitrate present in a relative amount of about 1 to about 70 composition weight percent;

the oxidizer is basic copper nitrate present in a relative amount of about 10 to about 70 composition weight percent; and the copper complex is present in a relative amount of between about 1 to about 30 composition weight percent.

15. The method of claim 1 wherein the compound comprises a copper II complex of bis-imidazole, bis-nitroimidazole, imidazole hydroxide, nitroimidazole hydroxide, imidazole nitroimidazole and mixtures thereof.

16. The method of claim 1 wherein the copper complex comprises copper II bis-imidazole.

17. The method of claim 1 wherein the copper complex comprises copper II bis-4-nitroimidazole.

18. The method of claim 1 wherein the copper complex comprises copper II imidazole hydroxide.

19. A method for improving the combustion performance of a gas generant composition in at least one aspect selected from the group consisting of ignitability, burn rate and burn rate pressure sensitivity, the method comprising:

adding a compound comprising at least one copper II complex of a material selected from the group of imidazole and imidazole derivatives to a non-azide gas generant composition consisting essentially of:

a nitrogen-containing non-azide fuel and basic copper nitrate as an oxidizer;

in an amount sufficient whereby the composition includes between about 1 to about 30 composition weight percent of the copper complex.

* * * * *